US005643056A

United States Patent [19]

Hirose et al.

[11] Patent Number: 5,643,056

[45] Date of Patent: Jul. 1, 1997

[54] REVOLVING DRUM POLISHING APPARATUS

[75] Inventors: Masayoshi Hirose; Seiji Ishikawa; Norio Kimura; Yoshimi Sasaki; Kouki Yamada; Fujio Aoyama; Noburu Shimizu, all of Tokyo, Japan; Katsuya Okumura, Poughkeepsie, N.Y.

[73] Assignees: Ebara Corporation, Tokyo; Kabushiki Kaisha Toshiba, Kawasaki, both of Japan

[21] Appl. No.: 550,117

[22] Filed: Oct. 30, 1995

[30] Foreign Application Priority Data

Oct. 31, 1994 [JP] Japan ..... 6-290644
Jul. 20, 1995 [JP] Japan ..... 7-206590

[51] Int. Cl.[6] ..... B24B 1/00

[52] U.S. Cl. ..... 451/41; 451/182

[58] Field of Search ..... 451/41, 182, 183, 451/231, 254, 258, 446, 285–290

[56] References Cited

U.S. PATENT DOCUMENTS

| | | | |
|---|---|---|---|
| 15,773 | 9/1856 | Nippes | 451/254 |
| 1,223,155 | 4/1917 | Drake | 451/254 |
| 1,665,954 | 4/1928 | Fox | 451/254 |
| 4,016,855 | 4/1977 | Mimata | 451/41 |
| 4,513,543 | 4/1985 | Lawrenson et al. | 451/41 |
| 4,564,000 | 1/1986 | Stern et al. | 451/41 |
| 4,934,102 | 6/1990 | Leach et al. . | |
| 5,083,401 | 1/1992 | Yamashita et al. | 451/41 |
| 5,094,037 | 3/1992 | Hakomori et al. | 451/11 |
| 5,097,630 | 3/1992 | Maeda et al. | 451/254 |

FOREIGN PATENT DOCUMENTS

| | | | |
|---|---|---|---|
| 2-269552 | 11/1990 | Japan . | |
| 404082662 | 3/1992 | Japan | 451/178 |

*Primary Examiner*—James G. Smith
*Assistant Examiner*—Derris H. Banks
*Attorney, Agent, or Firm*—Wenderoth, Lind & Ponack

[57] ABSTRACT

A drum-type polishing apparatus for producing a flat mirror polish on an object such as a semiconductor wafer, is capable of three degrees of freedom of movement of a drum member with respect to the wafer. The relative movements can be made, successively or simultaneously, at right angles to an axis of the drum, parallel to the surface of the wafer, as well as at any desired angular orientations. Combined with a follower device to provide automatic compensation for unevenness in pressing pressure applied to the wafer during polishing, the polishing apparatus offers outstanding uniformity in polishing quality and high productivity, even for large diameter wafers, with a comparatively modest investment in both facility space and equipment cost.

39 Claims, 12 Drawing Sheets

REVOLVING DRUM POLISHING APPARATUS

BACKGROUND OF THE INVENTION

1. Field of the Invention

The present invention relates in general to an apparatus for polishing of materials, and relates in particular to a polishing apparatus having a revolving drum with a polishing pad mounted thereof for polishing an object such as a semiconductor wafer to a flat and mirror finish.

2. Description of the Related Art

High density integrated semiconductor devices of recent years require increasingly finer microcircuits, and the trend is for interline spacings also to be of steadily decreasing size. For optical lithography operations based on less than 0.5 micrometer interline spacing, the depth of focus is shallow and high precision in flatness is required on an object to be polished which has to be coincident with the focusing plane of the stepper. This requirement means that the wafer surface must be made extremely flat, and a first step in achieving such precision in flatness begins with proper surface preparation by polishing with a polishing apparatus.

FIG. 12 shows an example of a conventional type of polishing apparatus comprising a turntable 30, a top ring 31 which exerts a certain pressing pressure on the turntable 30 and an object 32 to be polished, such as a semiconductor wafer, which is disposed therebetween. A polishing pad 34 is disposed on the top surface of the turntable 30 against which the object is rotated to provide a flat and mirror polished surface. A discharge nozzle 33 is used to supply a polishing solution Q onto the polishing pad 34 which acts to retain the polishing solution Q. Usually, polishing is carried out by holding the object 32 below the top ring 31 so that the surface to be polished faces the polishing pad 34. In such an arrangement of the polishing apparatus, to provide a sufficient relative revolution speed between the surface to be polished and the polishing pad 34, the center axes of the top ring and the turntable are offset, i.e., not made concentric, so as to provide sufficient rotational displacement of the wafer relative to the polishing pad. This type of arrangement necessitates a configuration wherein the outer diameter of the turntable must be several times larger than that of the semiconductor wafer object. Further, it is also necessary to provide sufficient strength and rigidity, while maintaining the horizontal alignment of the turntable, to the turntable and the table frame so as to prevent the generation of harmful vibration of the rotating turntable, which vibration would interfere with the polishing process. For the polishing apparatus of the type shown in FIG. 12, these design requirements inevitably lead to the necessity of providing a large-space facility to accommodate a large polishing apparatus.

Furthermore, in a polishing apparatus of the type mentioned above in which the object is held on the top ring 31, the surface of the semiconductor wafer 32 being polished is pressed against the polishing pad 34 on the turntable, and it is not possible to view the condition of the wafer surface during the polishing operation. The result is that it is difficult to determine the amount of surface material (such as surface oxide film) removed or remaining on the wafer without disturbing the wafer in some way. Methods for determining the amount of film material removed or remaining have been presented, for example, in U.S. Pat. No. 5,089,716 which relates to moving a wafer away from a turntable during polishing. Another method, according to U.S. Pat. No. 5,196,353 is based on measuring variations in the temperature of the wafer to determine the elapsed time of polishing.

However, such methods lead to a complex configuration of the apparatus, and in particular, although both methods permit some observation of the surface condition, the former relies on intermittent examination of the surface during polishing, while the latter relies on an indirect method based on the temperature variation in the wafer. In either case, it is difficult to obtain a satisfactory level of measurement precision.

On the other hand, Japanese Laid-open Patent Publication H2-269552 discloses a polishing apparatus having a revolving drum of cylindrical shape which revolves while polishing a wafer surface to be polished by contacting the wafer surface with a circumferential peripheral surface of the drum. The contact interface between the drum and the wafer surface is essentially along a line-shaped region on the surface to be polished, and a polishing solution is supplied to the contact region while some relative linear movement is provided along a path suitably directed with respect to the drum axis.

The polishing apparatus having such a revolving drum does not require a large diameter turntable as is required with the type of apparatus shown in FIG. 12, and therefore, the drum-type apparatus can be made compact and light weight. Also, an important advantage is that this type of apparatus enables an operator to observe the surface of the semiconductor object being polished, and to provide an accurate measure of the film thickness polished off or yet remaining on the wafer.

However, according to the method and the apparatus disclosed in the above-noted Japanese Laid-open Patent Publication H2-269552, polishing occurs only at the linear contact region between the revolving drum and the object. Therefore, when polishing a round object such as a semiconductor wafer, there is a tendency for the outer peripheral region of the wafer to be subjected to a higher pressing pressure than in the central region of the wafer, leading to higher rates of material removal in the peripheral region of the water, thus causing the so-called phenomenon of "peripheral degradation". Further, because polishing occurs at the linear contact region, it is difficult to apply an even pressure across the entire surface of the object. For example, of for some reason there is insufficient pressing pressure applied to the object during polishing of a local area thereof, there is a tendency to generate a wavey pattern on the polished surface, resulting in localized non-uniform polishing and potential generation of rejects.

SUMMARY OF THE INVENTION

It is an object of the present invention to provide a polishing apparatus enabling a uniform pressing pressure to be applied on an entire surface of a polished object, thereby to provide uniform polishing over the entire polished surface of the object, while fully retaining the advantages offered by the revolving drum-type arrangement.

Such object has been achieved in accordance with the invention by a polishing apparatus including a revolving drum having a polishing pad mounted on an outer circumferential surface thereof. A seat member has a top surface on which is to be disposed an object to be polished. Pressing means presses the drum onto a surface of the object to be polished. Rotation means revolves the drum. Moving means moves the drum or the seat member so as to enable the drum to contact the entire area of the surface to be polished. Supply means supplies a polishing solution containing fine particles to the polishing pad so as to achieve a polishing operation by polishing solution retained in the polishing pad.

The moving means is operable to produce relative movements of the object with respect to the drum, successively or simultaneously, in a direction orthogonal to an axis of the drum and in a direction parallel to the surface to be polished, as well as in selected orientational directions.

According to the above apparatus, in addition to the two degrees of freedom of linear movement, an angular orientation movement has been provided to further enhance the quality of polishing, even when a partial deficiency or excess of pressing pressure exists between the object and the polishing pad mounted on the drum, by preventing the formation of wavy polishing patterns on the object, e.g. a wafer. Therefore, even for large diameter wafers, it is possible to obtain highly uniform polishing over the entire surface of the wafer.

An aspect of the above apparatus is that a sacrificial member is disposed on an outer periphery of the object so as to be substantially coplanar with the surface to be polished of the object. By providing such sacrificial member with respect to the object, the pressing pressure applied at a peripheral section of the wafer can be made equal to that in the central section of the wafer, thereby preventing the problem of applying an increased pressure on the peripheral region of the wafer and avoiding the consequent problem of peripheral degradation.

Another aspect of the above apparatus is that an elastic member is inserted between the sacrificial member and the seat member. By providing such an elastic member in strategic locations, uniform polishing can be produced, owing to the cushioning effect of the elastic member, even when there is a variation in the thickness of the wafer across the polishing surface and perfect matching of the surfaces of the sacrificial member and the object would not normally be attained.

Another aspect of the above apparatus is that follower means are provided below the seat member in the form of a rod-shaped support member for supporting the seat member such that an axis of the support member is disposed perpendicular to the axis of the drum and parallel to the top surface of the seat member, thereby to produce a follower action in an interface contact region between the surface to be polished and a contact surface of the polishing pad. This provides an equalized pressing pressure across the interface contact region. By providing such follower device with the rod-shaped support member, rotation of the support member enables automatic alignment of the polished surface of the object with the drum axis, thereby to provide uniform polishing over the entire surface of the object.

Another aspect of the above apparatus is that the pressing means includes a diaphragm member fixed to the seat member or to the drum. A pneumatic cushion provides a uniform pressure to the diaphragm member so as to produce a follower action in an interface contact region between the surface to be polished and a contact surface of the polishing pad, thus to provide an equalized pressing pressure across the interface contact region. According to this arrangement of the pressing structure, the combined effect of the diaphragm and the air cushion produces outstandingly uniform polishing over the entire surface of the polished object.

Another aspect of the above apparatus is that a control means is provided so that the pressing means provides a pressing pressure proportional to an interface contact length of an essentially line contact region between the polishing pad and the surface to be polished. By provision of such control device, it is possible to produce uniform polishing over the entire surface of the polished object while maintaining the speed of revolution of the drum constant by an automatic compensation for varying contact lengths to generate a constant pressure, regardless of the length of interface contact. Thereby, it is possible to avoid the problem that the amount of material removed by polishing increases near a peripheral region of the object, e.g. a wafer.

Another aspect of the above apparatus is that a control means is provided for controlling revolution speeds of the drum so as to provide a constant polishing speed, even though an interface contact length, of an essentially line contact region between the polishing pad and the surface to be polished, may vary. By provision of such control device, the polishing speed can be maintained constant, regardless of the length of interface contact, by an automatic compensation for varying contact lengths, thereby to generate a constant pressure regardless of the length of interface contact. Thus is avoided the problem that the amount of material removed by polishing increases near the peripheral region of the object, e.g. wafer.

Another aspect of the above apparatus is that a relative speed of movement between the drum and the polished object is controlled to be inversely proportional to an interface contact length of an essentially line contact region between the polishing pad and the surface to be polished. By provision of such control device, depending on the nature of the object being polished, it may be necessary to employ an opposite parametric relationship to that presented above so as to maintain the polishing speed constant regardless of the length of interface contact, thereby producing an automatic compensation for varying contact lengths to generate a constant pressure regardless of the length of the interface contact, and avoiding the problem that the amount of material removed by polishing increases near the peripheral region of the object, e.g. wafer.

PREFERRED EMBODIMENTS OF THE INVENTION

Figure 1:
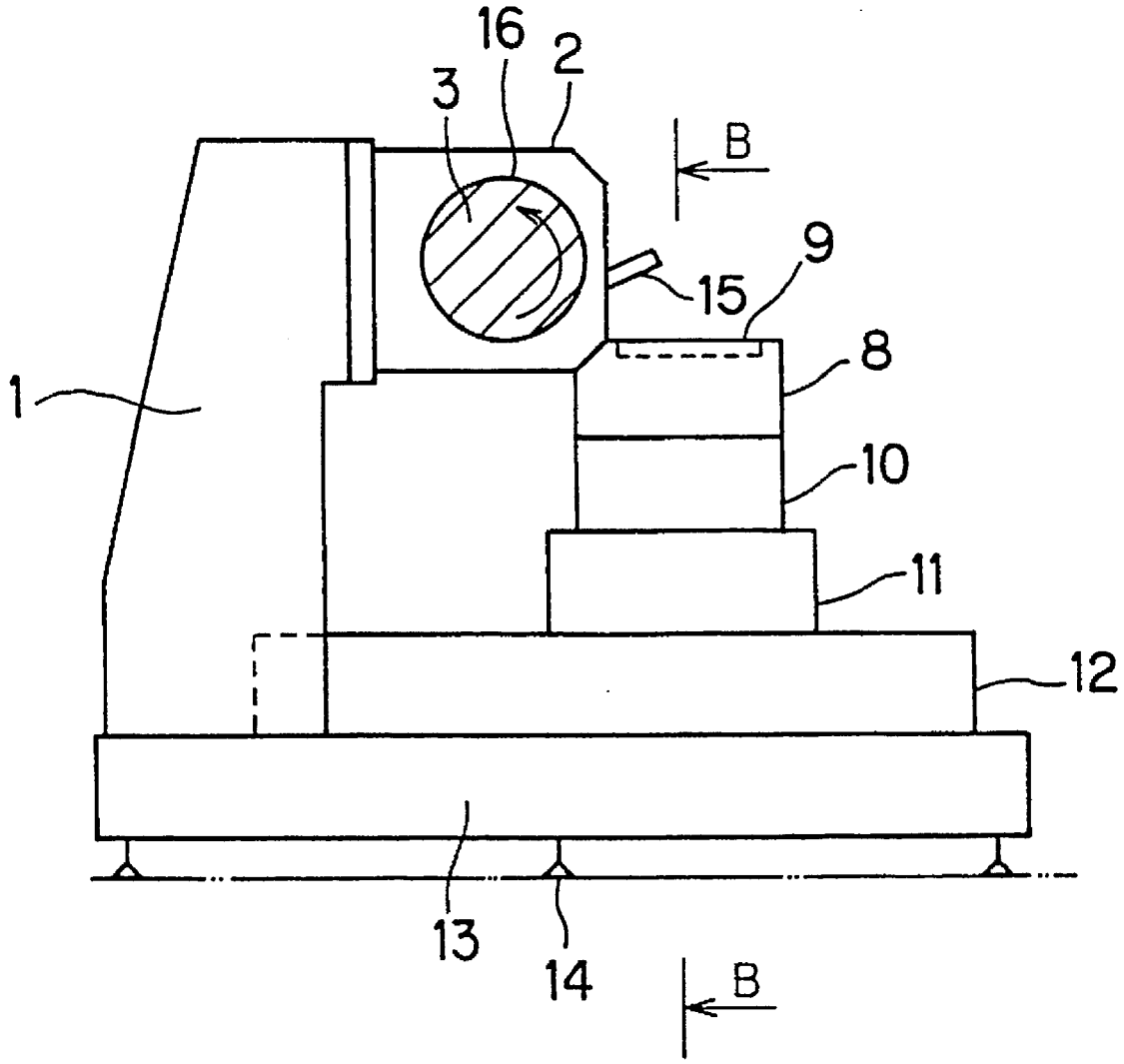
FIG. 1 is a side view of an embodiment of the polishing apparatus of the present invention.

A preferred embodiment of the polishing apparatus of the present invention will be explained with reference to the drawings. The parts which are common or equivalent in the various drawings are indicated by the same reference numerals.

Figure 2:
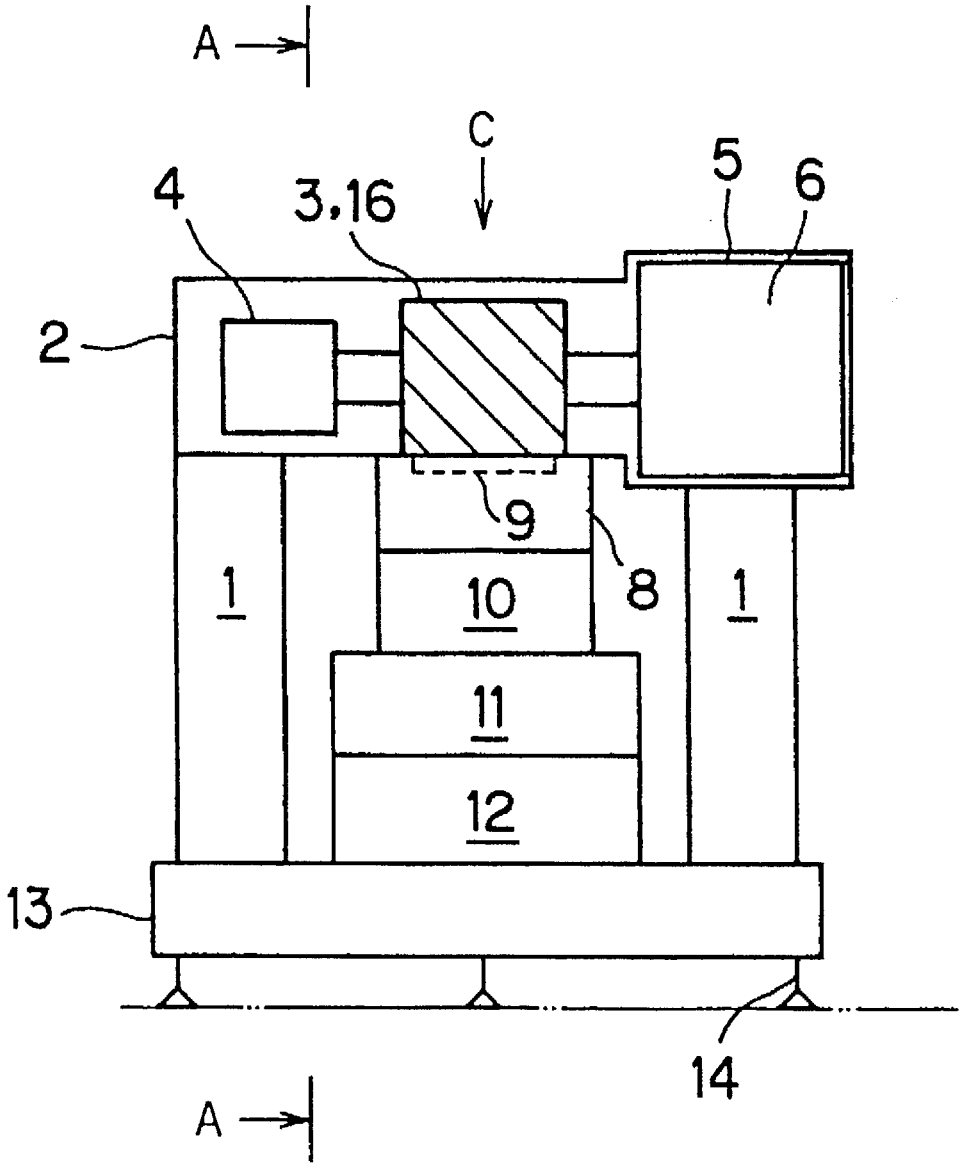
FIG. 2 is a front view of the apparatus shown in FIG. 1.

FIG. 1 is a side view and FIG. 2 is a front view of the polishing apparatus of the present invention. This polishing apparatus is provided with a revolving drum 3 having a polishing pad 16 mounted on its outer peripheral surface for retaining a polishing solution containing fine particles. The drum 3 is supported at its axis by bearings 4, 5 within a drum head 2, and is driven by a drum motor 6. The drum head 2 is attached to a base 13 by columns 1. A semiconductor wafer 9, which is an object to be polished, is held on a top surface of a seat member 8 by vacuum suction. The seat member 8 is fixed to a Y-table 11 through a follower device 10. Referring to FIG. 2, the Y-table 11 is a device to oscillate the semiconductor wafer which is the polished object 9 laterally in the Y-direction (coincident with the drum axis). An X-table 12, which is fixed to the base 13, is a device to move the polished object 9 in the X-direction (orthogonal to the drum axis) over the entire length dimension of the object 9. The base 13 is firmly fixed to the facility floor through leveller device 14. The leveller device 14 is a device for adjusting the level orientation of the surface of the semiconductor wafer 9. A polishing solution Q containing fine particles is delivered through a supply nozzle 15 to the surface of the polishing pad 16 mounted on the outer peripheral surface of the drum 3. Polishing is performed at contact interface between the semiconductor wafer 9 and the revolving action of the polishing pad 16 retaining the polishing solution containing fine particles.

Figure 3:
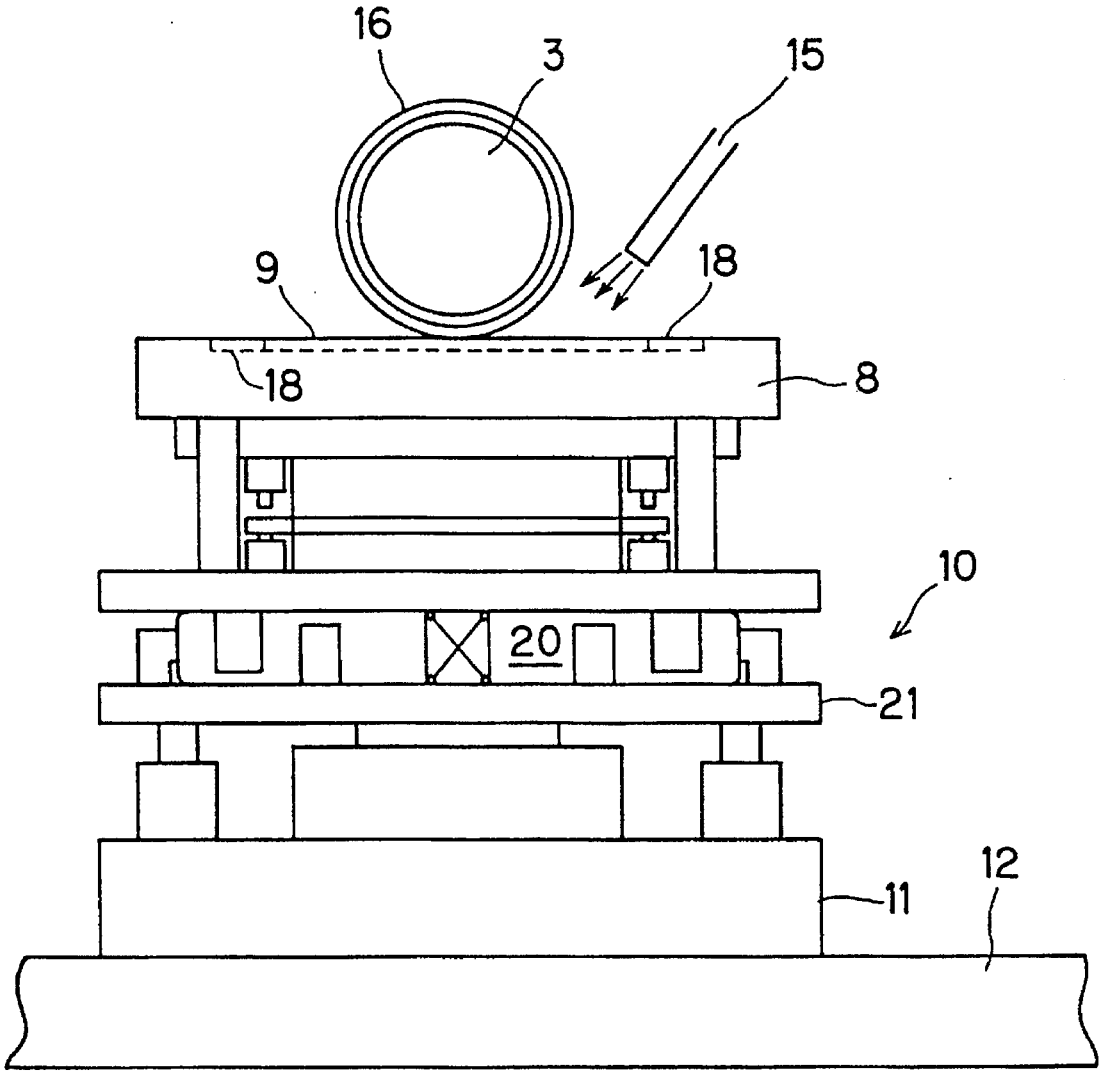
FIG. 3 is a view taken along line A—A in FIG. 2.
Figure 4A:
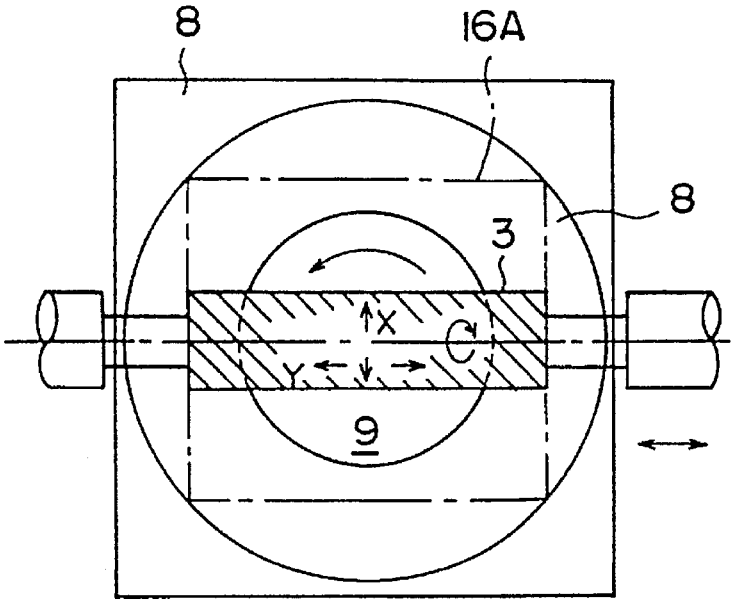
FIG. 4A is a view taken in the direction of arrow C shown in FIG. 2.
Figure 4B:
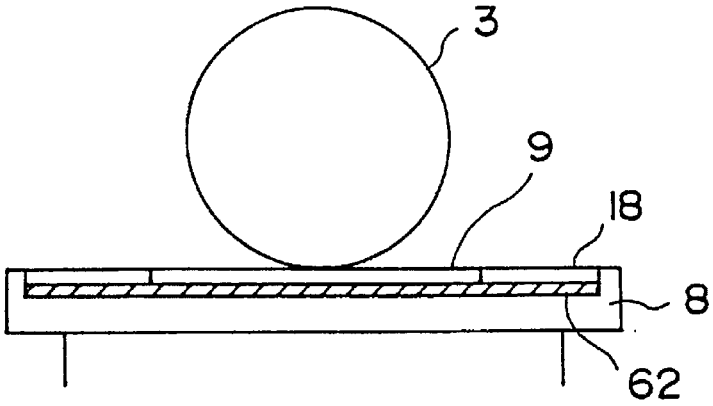
FIG. 4B is a cross sectional side view of the apparatus shown in FIG. 4A.
Figure 4C:
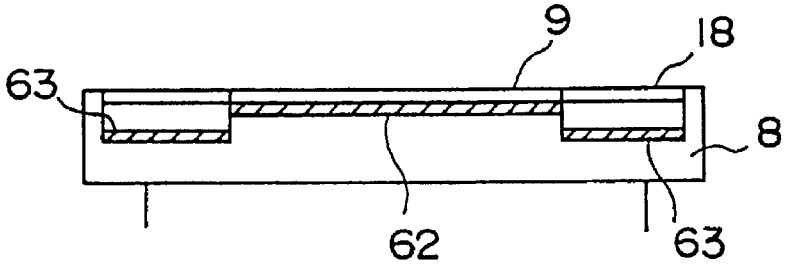
FIG. 4C is a cross sectional side view of the apparatus shown in FIG. 4A.
Figure 5:
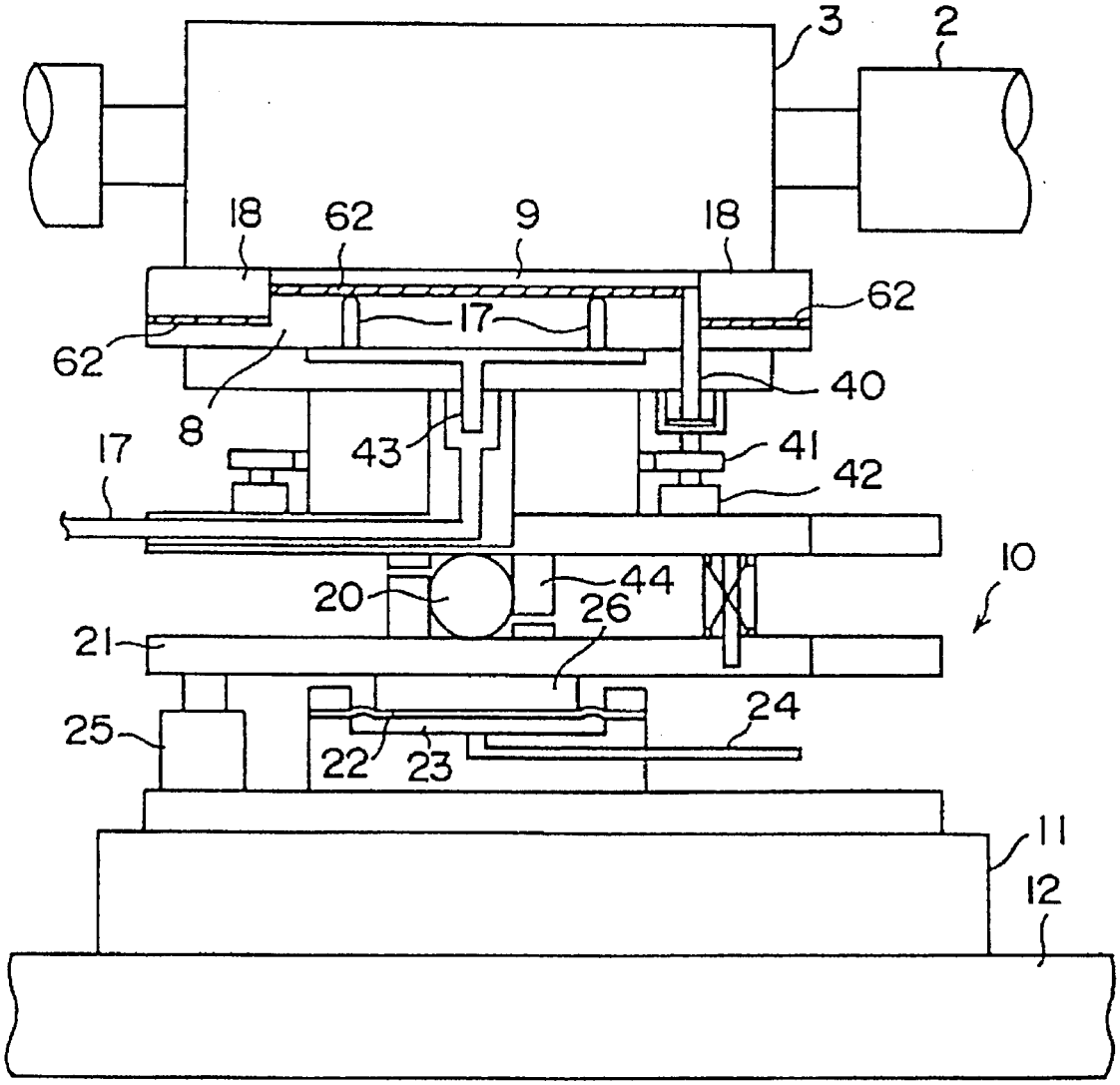
FIG. 5 is a cross sectional view taken along line B—B in FIG. 1.

FIG. 3 is a view along section A—A in FIG. 2, FIG. 4A is a view seen in the direction of arrow C in FIG. 2, and FIG. 5 is a cross sectional view along section B—B in FIG. 1. FIGS. 4B and 4C are cross sectional views of a central section shown in FIG. 4A.

As shown in FIGS. 4A and 5, the polishing apparatus is provided with a sacrificial member 18, which is in a form of a ring in this case, for preventing peripheral degradation of the object being polished.

When polishing a round object such as a semiconductor wafer 9 using the drum type of polishing apparatus, the polishing pad 16, in moving from outwardly of the wafer 9 to inwardly thereof, encounters a step created by the thickness of the wafer 9 at the peripheral region thereof. Peripheral degradation at the peripheral region of the wafer is caused by a localized compression stress exerted on the polishing pad 16 by an edge of the wafer 9, resulting in such abnormal behavior as squeezing out of the polishing solution and fine particles normally retained within the polishing pad 16 and/or changes in the surface characteristics of the polishing pad 16. These abnormal conditions lead to non-uniformity in polishing performance of the polishing pad 16 and cause local wear of the upper edge of the wafer 9 to produce non-flatness near the upper edge, i.e. the so-called peripheral degradation.

The sacrificial ring 18 is provided at the outer periphery of the object 9 disposed on the seat member 8 so that the height of the sacrificial ring is substantially the same or slightly lower than the height of the object. The sacrificial ring 18 is made of a hard material such as fine ceramics, glassy carbon or stainless steel. When the wafer 9 is being polished, the sacrificial ring 18 is similarly subjected to compressive stress from the polishing pad 16, and the surface of the sacrificial ring 18 is subjected to localized polishing as described above, leading to localized wear of the sacrificial ring 18 but preservation of the profile of the corner of the wafer 9. This is a solution to the problem of the excessive localized removal of the material from the outer peripheral region of the wafer 9. To prevent an adverse effect on the sacrificial ring 18, it is desirable to select the dimension of the sacrificial ring 18 to extend over the entire capacity of motion 16A of the polishing pad 16, as shown in FIG. 4A.

Various arrangements of the sacrificial ring 18 are possible. For example, FIG. 4B shows mounting both the sacrificial ring 18 and the wafer 9 on the same plane on the seat member 8. If the sacrificial ring 18 is made of a low strength material and danger of breakage exists, a reinforcing member 63 made of material such as plastic may be placed underneath the sacrificial ring 18 as shown in FIG. 4C.

As illustrated in the cross sectional views of FIGS. 4B and 4C, an elastic member 62 of about 0.6 mm in thickness, made of rubber or backing film, is provided between the seat member 8 and both the wafer 9 and the sacrificial ring 18 (or the reinforcing member 63). The thickness of the wafer 9 itself is variable over several tens of micrometers, and it is impossible to perfectly match the level of the heights of the surfaces of the sacrificial ring 18 and the wafer 9. A height of a step created by such small difference in the height dimensions of the sacrificial ring and the wafer is sufficient to adversely affect the polishing pad when the ring and the wafer are placed directly on the seat member 8 so that a flat surface cannot be obtained. This is especially true when the pressing pressure during polishing is increased to increase productivity.

By inserting elastic member 62 between the member 8 of the object and the sacrificial member, the effect of such step created by the height difference can be moderated considerably to improve the flatness achievable during polishing.

Figure 6A:
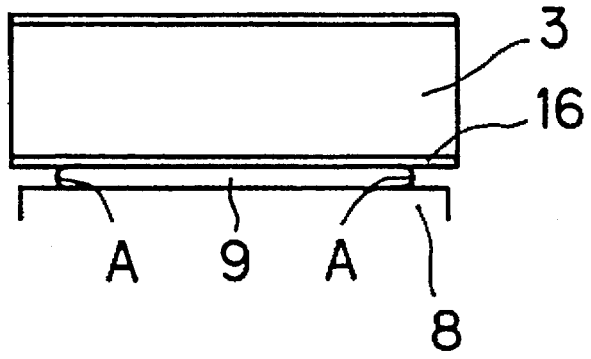
FIG. 6A is a view illustrating a polishing operation without the use of a sacrificial plate member.
Figure 6B:
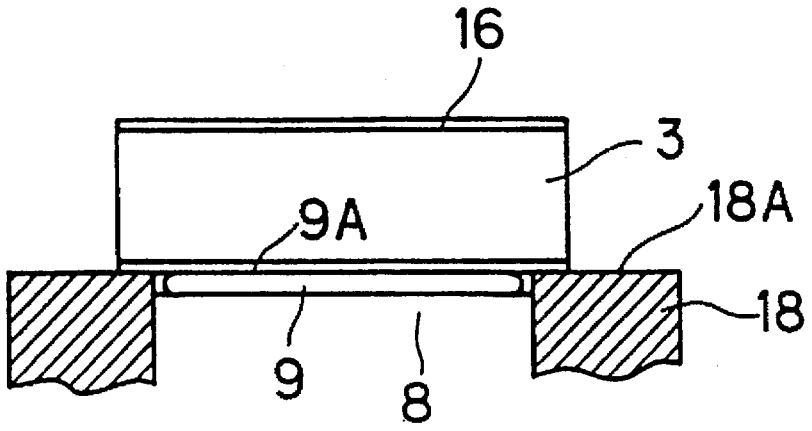
FIG. 6B is a similar view illustrating a polishing operation with the use of a sacrificial ring member.

FIG. 6A illustrates how peripheral degradation is caused when polishing is performed without a sacrificial ring. The peripheral section A of the wafer 9 experiences localized compression stress when it encounters the polishing pad 16. FIG. 6B shows use of a sacrificial member 18 which in this case is a ring-shaped member surrounding the external periphery of the wafer 9. In this arrangement, the surface 18A of the sacrificial member 18 and the surface 9*a* to be polished of the wafer 9 are at about the same height. The compressive load of the drum 3 is distributed approximately evenly over the surfaces 9A, 18A to avoid stress concentration on the polishing pad 16.

The wafer 9 is held on or moved off the seat member 8 by means of vacuum/pressure pipe 17 shown in FIG. 5. During polishing, the wafer 9 is held on member 8 by vacuum suction, and when polishing is completed the wafer 9 is removed from member 8 by use of pressurized air. The wafer 9 can be lifted by a push-up ring 41 fixed on a wafer push-up pin 40 and operated by a pneumatic cylinder 42, thus to detach the wafer when the wafer is snugly held in the seat member 8.

The seat member 8 is made to be freely rotatable through a rotary joint 43 so as to rotate the wafer 9 about an axis thereof by means of a rotary driving device (not shown).

The polishing apparatus is provided with two types of follower devices to enable the wafer to be pressed against the contact interface between the wafer and the revolving drum. The first follower device is shown in FIG. 5, and comprises a rod-shaped support member 20 supporting the seat member 8 from below, and disposed to be perpendicular or orthogonal to the drum axis and parallel to the surface of the seat member 8. The follower device 20 operates when parallelism between the drum axis and the wafer 9 is disturbed for any reason during polishing. The rod-shaped support member 20 achieves self-levelling by rotating slightly to realign the wafer 9 parallel to the drum axis so as to achieve a balanced pressing pressure on the wafer 9. Therefore, the surface of the wafer 9 to be polished over the entire contact interface with the drum is subjected to a balanced pressing pressure with respect to the revolving drum. This is an important factor in obtaining a uniform flat mirror polish on the polished surface. Component member 44 is used to prevent escape of the support member 20.

A second follower device comprises a diaphragm 22, to which a bottom section of an elevator seat 21 is fixed, and an air cushion supporting diaphragm 22. The elevator seat 21 is freely movable in the vertical direction along guide rods 25. The bottom surface of the elevator seat 21 is fixed to the diaphragm 22 through a connecting part 26. A space 23 at the bottom of the diaphragm 22 forms an air cushion with compressed air delivered from an air pipe 24. The air cushion provides a uniform pressure over the entire area of the diaphragm 22 through the elevator seat 21 so as to apply even pressure at the contact interface between the drum 3 and the wafer 9. This is another important factor in providing a flat mirror polish on the wafer 9.

The first follower device provides a line support parallel to the axis of the round member 20, while the second follower device provides an area support over the entire area of the diaphragm 22. The combination of the two devices provides a significantly enhanced uniform pressing action on the object to be polished.

The elevator seat 21 is capable of being moved up and down by means of an air cylinder (not shown). Vertical movements for exchanging of wafers 9 and the like are carried out by raising or lowering the diaphragm 22 by adjusting the air cushion 23. Greater movements for the purpose of maintenance operations and the like are carried out by raising or lowering the elevator seat 21 by the air cylinder (not shown).

Figure 7A:
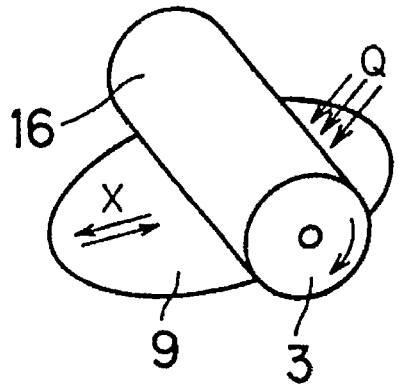
FIG. 7A is a perspective view showing operation of the revolving drum type polishing apparatus of the present invention.
Figure 7B:
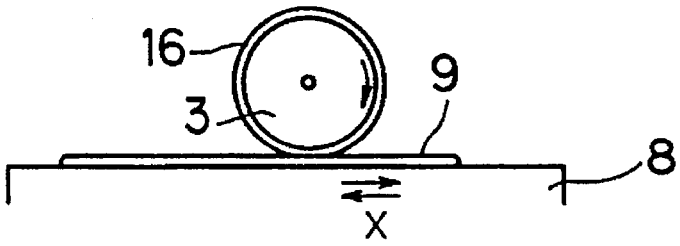
FIG. 7B is a side view showing operation of the revolving drum type polishing apparatus of the present invention.
Figure 7C:
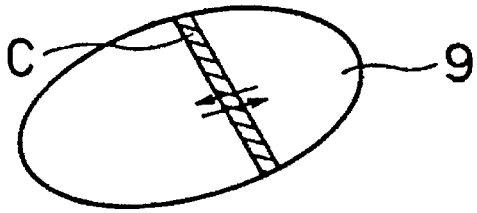
FIG. 7C is a perspective view of a polished surface C showing operation of the revolving drum type polishing apparatus of the present invention.

FIGS. 7A to 7C illustrate the basic operations of the polishing apparatus. As shown in FIGS. 7A and 7B, drum 3 having polishing pad 16 is rotated against the surface of wafer 9 to be polished. As shown in FIG. 7C, contact interface C is substantially a line contact. Seat member 8 having mounted therein wafer 9 is moved in the X-direction against the drum 3 whose axis is movable in the Y-direction to provide overall polishing of the entire area of the surface of the wafer 9.

Figure 12:
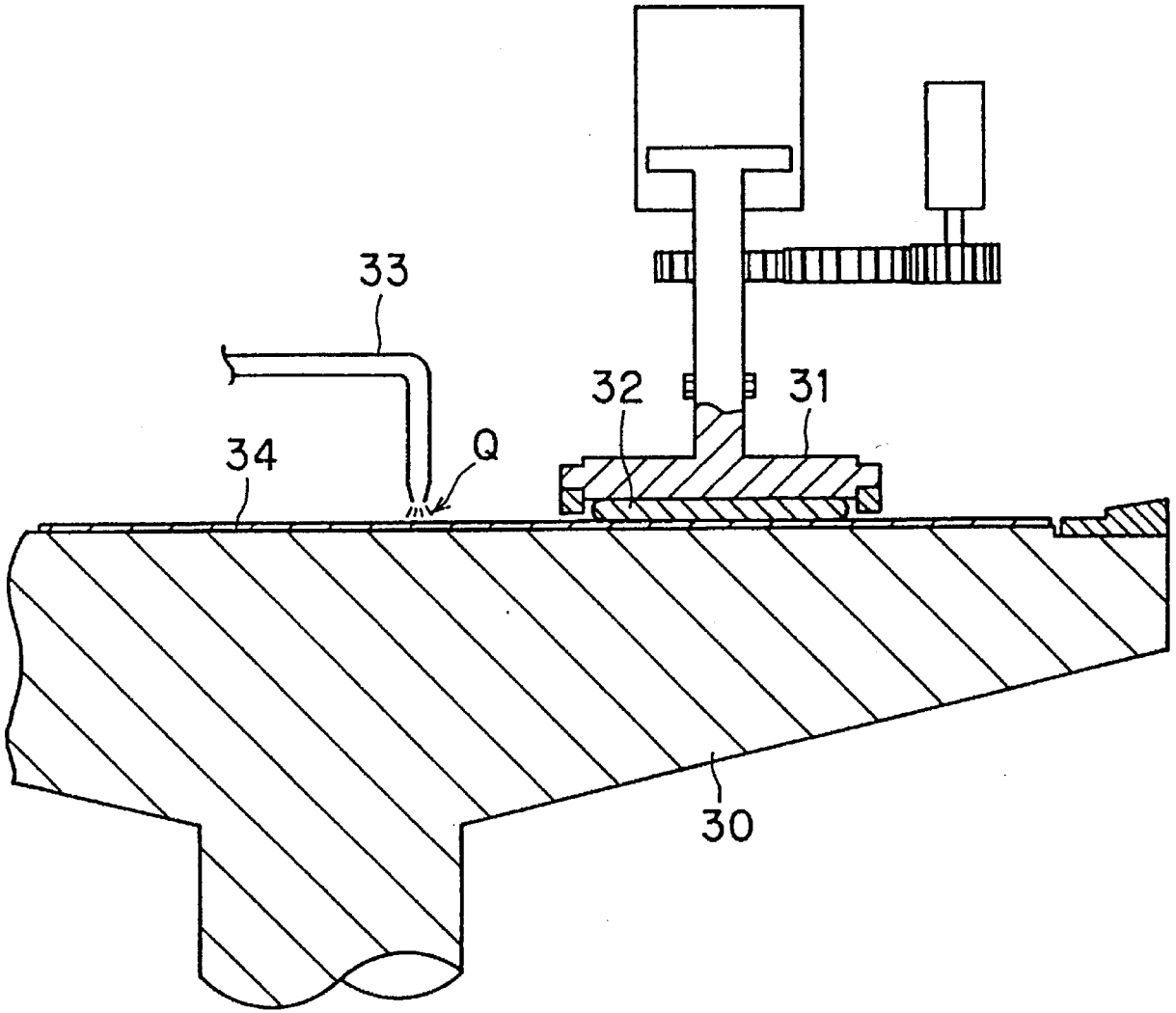
FIG. 12 PRIOR ART
FIG. 12 is a partial cross sectional view of a conventional polishing apparatus.

The polishing apparatus having the above features enables significant reduction of the overall size of the apparatus compared with the conventional polishing apparatus shown in FIG. 12, because the working space required need only be large enough to accommodate a revolving drum and a seat member moving mechanism for moving the wafer 9 mounted on the seat member. Furthermore, the present invention enables observation of the surface being polished from above the object, thus permitting confirmation of a film thickness removed or remaining continually during a polishing operation.

Figure 8A:
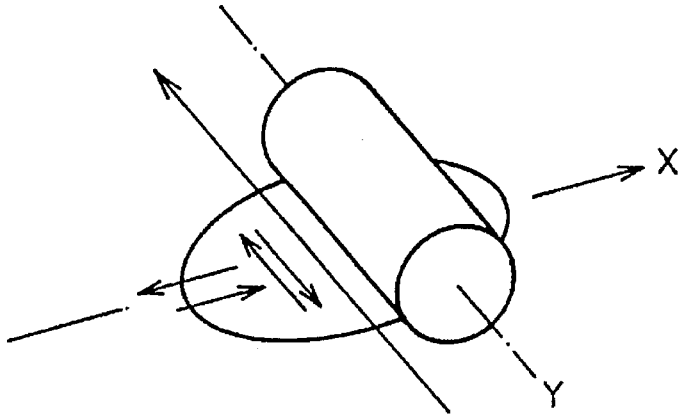
FIG. 8A is a perspective view showing a polishing operation combining lateral and orthogonal motions of the drum.
Figure 8B:
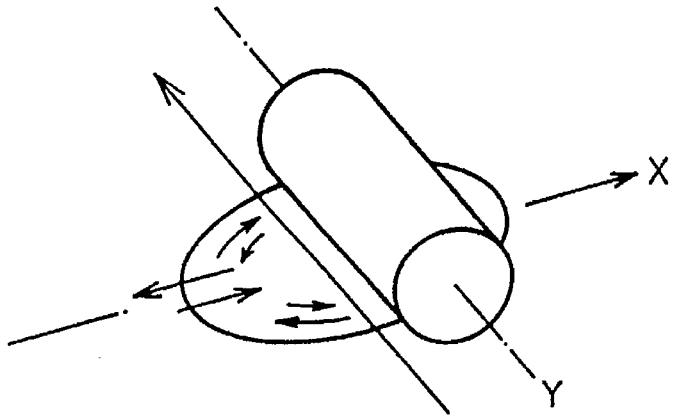
FIG. 8B is a similar view showing a polishing operation combining lateral and rotational oscillation motions of the drum.
Figure 8C:
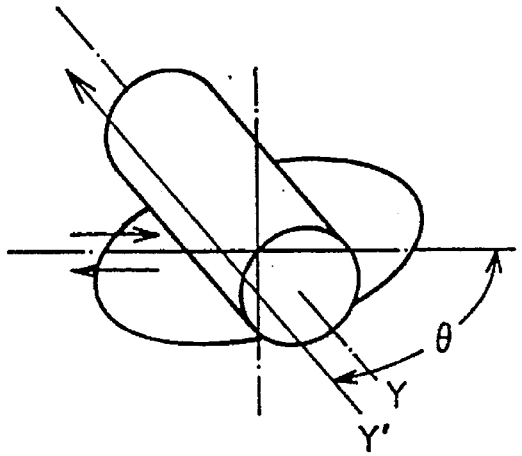
FIG. 8C is a similar view showing polishing operation combining lateral motion and shifting of a drum revolution axis.

FIGS. 8A to 8C illustrate operation of the moving mechanism for moving the seat member which has the wafer mounted thereon. When the drum axis is fixed in position and the seat member is moved only in one direction (X-direction), the regions of the wafer experiencing non-uniform pressures would lead to uneven polishing resulting in wavy polishing patterns on the wafer. FIG. 8A illustrates moving the seat member in both the lateral direction (X-direction) and in the perpendicular direction (Y-direction). In this embodiment, in addition to an oscillation motion of the X-table 12 in the X-direction over the entire length dimension of the wafer 9, the Y-table 11 is oscillated in the Y-direction at a shorter period, thereby providing lateral as well as orthogonal movement to prevent the generation of uneven polishing patterns on the wafer. It should be noted that although the seat member is oscillated in this embodiment, it is equally effective to move the drum of the apparatus, i.e. by moving the drum head 2 of the drum 3.

FIG. 8B illustrates oscillatory rotation of the rotating components such as the wafer 9 mounted on the seat member 8 or the sacrificial ring 18. The rotating components of the seat member 8 are rotatable by means of the rotary joint 43 to provide a rapid oscillatory rotational motion to the seat member 8. This rotation motion of the seat member 8 is coupled with the movement of the X-table 12 in the X-direction provide a complete polishing operation over the entire surface of the wafer 9 to prevent the formation of wavy polishing patterns on the wafer 9.

FIG. 8C illustrates varying the relative angle of intersection between the drum revolution axis (Y-axis) and the lateral movement axis (X-axis) of the seat member from 90 degrees. In FIG. 8C, Y'-axis refers to a projected line of the drum revolution axis (Y-axis) on the wafer surface. By staggering the arrangement of the polishing patterns generated by the drum revolution and by the wafer movement, it is also possible to eliminate the generation of uneven polishing patterns.

Figure 9A:
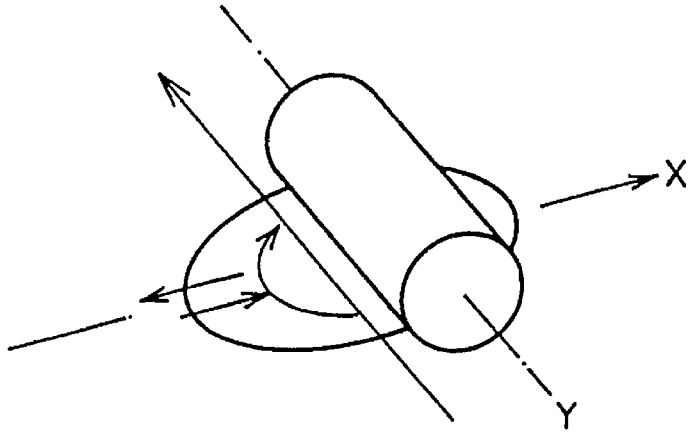
FIG. 9A is a similar view showing a polishing operation combining lateral and rotational motions.
Figure 9B:
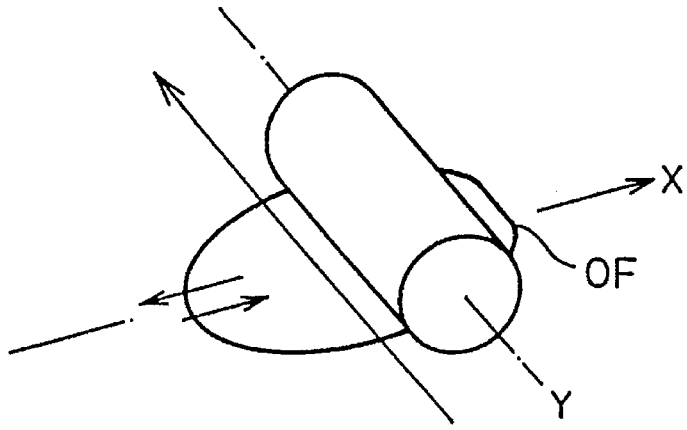
FIG. 9B is a similar view showing a polishing operation combining lateral polishing and rotational movement of a wafer surface during the polishing operation.
Figure 9C:
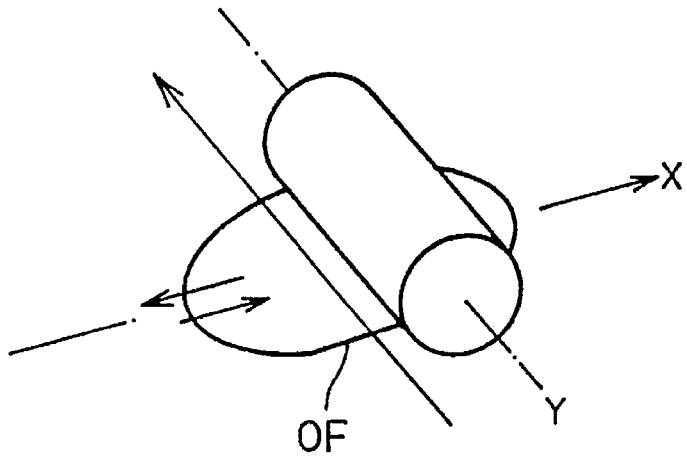
FIG. 9C is a similar view showing a polishing operation also combining a lateral polishing and rotational movement of the wafer surface during the polishing operation.

FIGS. 9A to 9C illustrate other examples of the relative movement of the drum and the wafer. FIG. 9A illustrates moving the seat member 8 in the X-direction, and rotating the rotation members including wafer 9 and the sacrificial ring 18 to perform polishing. Although the relative speed of the drum with respect to the wafer surface remains constant throughout the polishing process, the direction of polishing of the wafer is not kept constant, thereby preventing the generation of uneven polishing patterns.

FIGS. 9B and 9C illustrate moving the seat member in the X-direction only, and changing the orientation of the wafer midway through the polishing process to prevent the formation of uneven polishing. In more detail, the apparatus shown in FIG. 5 is used to polish a wafer by moving the seat member 8 first in the X-direction only, i.e., in a direction perpendicular to the orientation of a flat (OF in FIG. 9B) for a given time duration. Thereafter, the wafer 9 is disengaged from the drum 3 and the movement of the seat member 8 is stopped. The rotation components including the wafer 9 and the sacrificial ring 18 are rotated by 90 degrees, and the seat member again is oscillated in the X-direction to provide polishing in a direction parallel to flat OF. FIG. 9B shows the position of the wafer before rotation, and FIG. 9C shows the same after making such 90 degree rotation. The angle of rotation need not be limited to 90 degrees so long as the angle is not at or close to 0 or 180 degrees. The step of changing the orientation of the wafer during polishing can be performed not just once but may be carried out twice or more often as necessary.

At this time, the performance of the polishing apparatus and the amount of material removed by polishing will be examined. In general, the amount of material G removed by polishing will depend on the pressure P existing at the interface between the drum and the polished object, the relative speed (or the revolution speed of the drum) V between the polishing pad and the object and the polishing time T. These parameters are related by the following equation.

$G=\alpha PVT$ where a is a proportionality constant

In the drum-type polishing apparatus, polishing is carried out at an approximate line contact interface between the polishing pad mounted on the drum and the polished object. Therefore, when the polishing apparatus is polishing a round-shaped object such as a semiconductor wafer, the length L of the interface changes as the drum moves across the surface of the wafer. Therefore, when the pressing force is kept constant, the interface contact area changes and the pressure P exerted on the wafer changes, resulting in different polishing speeds in different regions of the wafer.

This will result in uneven polishing across the surface of the wafer. In more detail, the interface contact length L is long in the central region of the wafer, but becomes shorter near the peripheral or end regions of the wafer. Therefore, when the pressing force is kept constant, the pressing pressure P becomes high in the peripheral region, resulting in a high amount of material G removed, compared with that in the central region of the wafer.

Figure 10A:
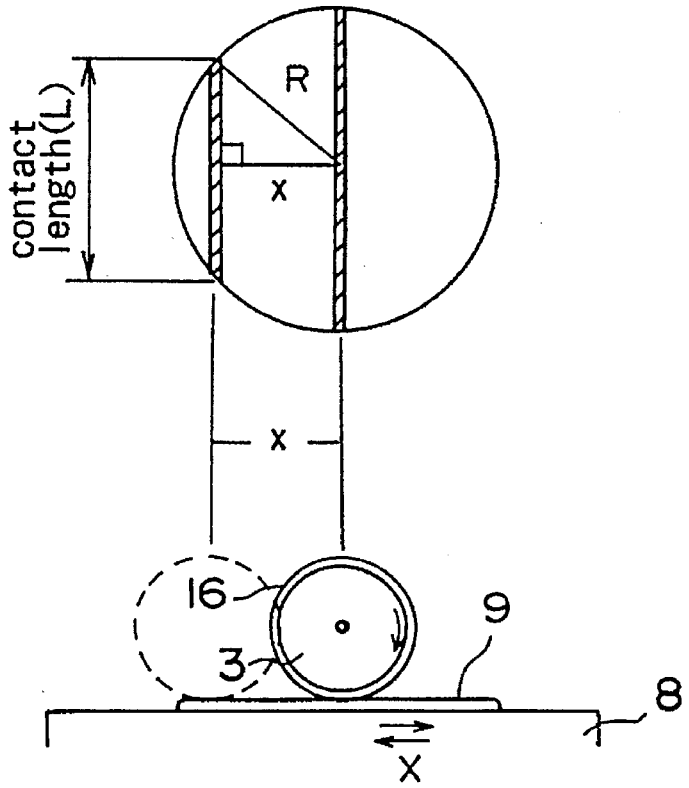
FIG. 10A is a schematic view illustrating the effect of contact length L of a contact region between the drum and the object being polished.
Figure 10B:
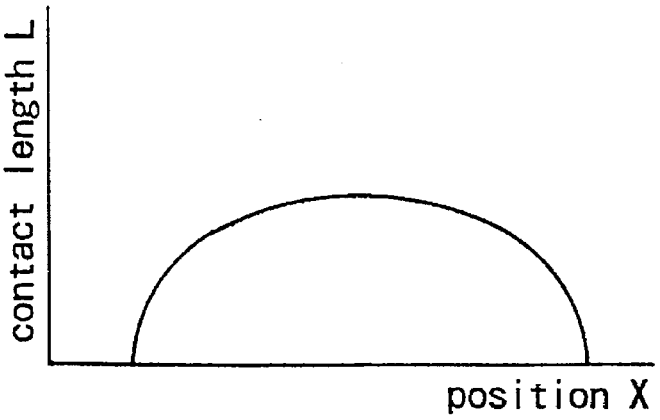
FIG. 10B is a graph illustrating the effect of the position X of the contact region and the contact length L.

To counter this effect, it is necessary to compensate for the changes in the pressing pressure P or the drum revolution speed or the relative speed V between the drum and the object introduced by the changes in the interface contact length L. As shown in FIG. 10A, the interface contact length L for a wafer of radius R is determined as follows.

$$L=2(R^2-X^2)^{1/2}$$

where X is obtained from the amount of movement of the X-table 12. The relationship between the interface contact length L and X is shown in FIG. 10B.

The pressing force S is given by the following equation.

$$P=\beta S/L=\beta S/(R^2-X^2)^{1/2}$$

where $\beta$ is a proportionality constant, and therefore, $$S=\gamma L$$

where $\gamma$ is another proportionality constant. It follows that by controlling the pressing force S to conform to the above equation, the pressing pressure P across the entire surface of the wafer can be made independent of the interface contact L, thereby producing uniform polishing across the entire surface of the wafer.

Figure 11:
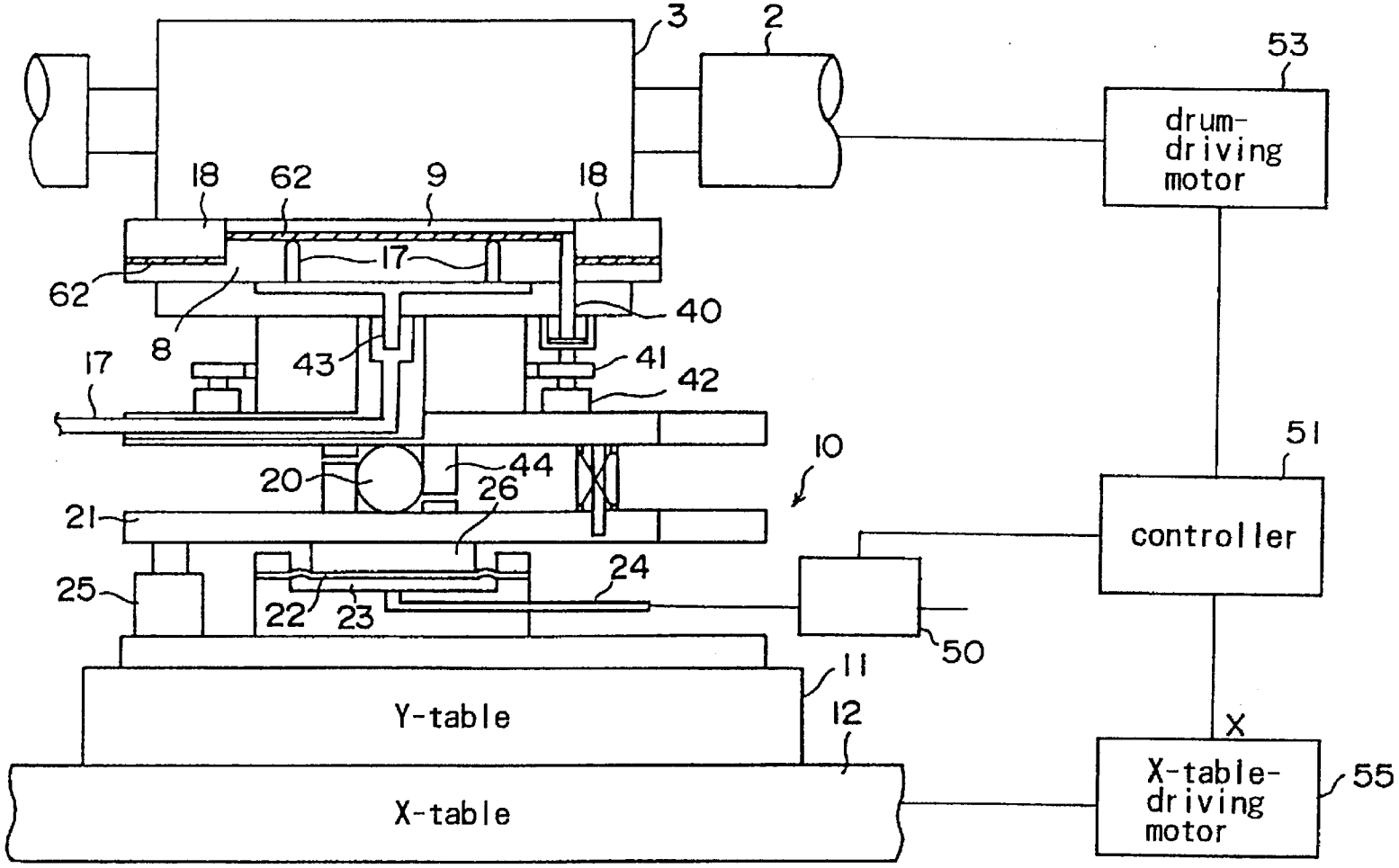
FIG. 11 is a schematic view illustrating operation of a control section to compensate for the effects of variation in the contact length L.

Therefore, a feedback control system as shown in FIG. 11 may be employed to provide a variable pressing force S. The amount of movement of the X-table 12 is input into a controller 51 to compute the interface contact length L so that the compressed air fed into the bottom space 23 of the diaphragm 22 is regulated appropriately by a regulator device 50 to satisfy the following equation.

$$S=\delta L=2\delta(R^2-X^2)^{1/2}$$

where $\delta$ is the final proportionality constant. By adjusting the pressing force S to conform to the above equation, a constant pressing pressure P will be generated to produce uniform polishing regardless of the interface contact length L.

The revolution speed V of the drum 3 can be controlled by providing the controller 51 with an appropriate signal to drive drum-driving motor 53. Therefore, while keeping the pressing force S constant, the revolution speed V of the drum may be varied according to the following equation to produce uniform polishing.

$$V=\delta L=\delta(R^2-X^2)^{1/2}$$

In view of the foregoing equations, $G=\alpha PVT$ and $P=\beta S/L$, it is obvious that regardless of the interface contact length L, a constant amount of material removal can be achieved. In FIG. 11, this mode of operation can be carried out by the controller 51 through feedback control of drum-driving motor 53.

It is also possible to control the speed of moving of the X-table 12 across the interface contact length L of the wafer 9 by feedback control of X-table-driving motor 55 shown in FIG. 11. An example may be to control the moving speed of the X-table 12 to be inversely proportional to L to obtain uniform polishing across the entire surface of the wafer.

Depending on the material being polished, there are cases in which the optimum polishing speed is not proportional to the interface contact length L, even though the pressing pressure is kept constant. If, for example, it is found that the optimum polishing speed is inversely proportional to the interface contact length L, then, contrary to the previous case, it is necessary to adjust the revolution speed V of the drum inversely with L to obtain uniform polishing across the entire surface of the wafer.

Furthermore, in the above embodiment, the position of the drum 3 was fixed, and wafer movement was achieved by moving the seat member side of the apparatus (the seat member 8 with the object mounted thereon). However, it is clear that the same objective of attaining uniform polishing on the wafer can be achieved by moving the drum of the apparatus with the seat member side of the apparatus being fixed. Similarly, it is also permissible to provide the follower devices on the drum side of the apparatus. It is clear that many variations and modifications may be possible by combining the various disclosed features within the principal intention of the present invention that uneven polishing of a polished object may be prevented by judicious choice of operating parameters of a line contact type polishing apparatus.

Summarizing the features of the polishing apparatus of the present invention, the apparatus offers a more compact and light weight design compared with the conventional disk type polishing apparatus, while retaining the advantage that the surface of the object can be observed during polishing. Peripheral degradation is prevented by providing a sacrificial member around the object to produce uniform pressing pressure and the resulting excellent high quality polished object. The inherent problem of varying interface contact length in polishing a circular object such as a wafer has been resolved by the integrated control of polishing variables so as to be consistent with the physical and mechanical characteristics of the polished object.

What is claimed is:

1. A polishing apparatus for polishing a surface of an object to a uniform polish, said apparatus comprising:

a seat member to support an object to be polished;

a revolving drum confronting said seat member and a surface of the object, said drum having mounted on an outer circumferential surface thereof a polishing material;

revolving means for revolving said drum;

a pressing device to cause said polishing material on said drum and the surface of the object to be in pressing contact;

supply means for supplying a polishing solution to said polishing material, thereby to achieve polishing of the surface of the object;

first moving means for moving one of said drum and said seat member in a direction orthogonal to an axis of said drum;

second moving means for moving one of said drum and said seat member in a direction parallel to said drum axis; and rotation means for rotating said seat member and the object.

2. An apparatus as claimed in claim 1, wherein said first moving means is operable to reciprocate said one of said drum and said seat member in said orthogonal direction.

3. An apparatus as claimed in claim 1, wherein said second moving means is operable to reciprocate said one of said drum and said seat member in said parallel direction.

4. An apparatus as claimed in claim 1, wherein said rotation means is operable to oscillatingly rotate said seat member and the object.

5. An apparatus as claimed in claim 4, wherein said moving means is operable to reciprocate said one of said drum and said seat member in said orthogonal direction.

6. An apparatus as claimed in claim 1, further comprising control means for controlling pressing contact between said polishing material on said drum and the surface of the object so that a pressing pressure therebetween corresponds to a length of a substantially rectilinear interface region of contact therebetween.

7. An apparatus as claimed in claim 1, further comprising control means for controlling said revolving means such that a speed of revolving of said drum provides a constant rate of polishing while a length of a substantially rectilinear region of interface contact between said polishing material and the surface of the object varies.

8. An apparatus as claimed in claim 1, further comprising control means for controlling at least one of said first moving means and said second moving means such that a relative speed of movement between said polishing material and the surface of the object varies inversely of variation in length of a substantially rectilinear region of interface contact therebetween.

9. A polishing apparatus for polishing a surface of an object to a uniform polish, said apparatus comprising:

a seat member to support an object to be polished;

a revolving drum confronting said seat member and a surface of the object, said drum having mounted on an outer circumferential surface thereof a polishing material;

revolving means for revolving said drum;

a pressing device to cause said polishing material on said drum and the surface of the object to be in pressing contact;

supply means for supplying a polishing solution to said polishing material, thereby to achieve polishing of the surface of the object;

moving means for moving one of said drum and said seat member in a direction orthogonal to an axis of said drum; and a sacrificial member on said seat member at a position to be disposed about an outer periphery of the object and having an upper surface to be substantially coplanar with the surface of the object.

10. An apparatus as claimed in claim 9, further comprising an elastic support member disposed between said seat member and said sacrificial member.

11. An apparatus as claimed in claim 9, wherein said moving means is operable to reciprocate said one of said drum and said seat member in said orthogonal direction.

12. An apparatus as claimed in claim 9, further comprising another moving means for moving one of said drum and said seat member in a direction parallel to said drum axis.

13. An apparatus as claimed in claim 12, wherein said another moving means is operable to reciprocate said one of said drum and said seat member in said parallel direction.

14. An apparatus as claimed in claim 9, further comprising rotation means for rotating said seat member and the object.

15. An apparatus as claimed in claim 14, wherein said rotation means is operable to oscillatingly rotate said seat member and the object.

16. An apparatus as claimed in claim 15, wherein said rotation means is operable to oscillatingly rotate said seat member and the object.

17. An apparatus as claimed in claim 9, further comprising control means for controlling pressing contact between said polishing material on said drum and the surface of the object so that a pressing pressure therebetween corresponds to a length of a substantially rectilinear interface region of contact therebetween.

18. An apparatus as claimed in claim 9, further comprising control means for controlling said revolving means such that a speed of revolving of said drum provides a constant rate of polishing while a length of a substantially rectilinear region of interface contact between said polishing material and the surface of the object varies.

19. An apparatus as claimed in claim 9, further comprising control means for controlling said moving means such that a relative speed of movement between said polishing material and the surface of the object varies inversely of variation in length of a substantially rectilinear region of interface contact therebetween.

20. A polishing apparatus for polishing a surface of an object to a uniform polish, said apparatus comprising:

a seat member to support an object to be polished;

a revolving drum confronting said seat member and a surface of the object, said drum having mounted on an outer circumferential surface thereof a polishing material;

revolving means for revolving said drum;

a pressing device to cause said polishing material on said drum and the surface of the object to be in pressing contact;

supply means for supplying a polishing solution to said polishing material, thereby to achieve polishing of the surface of the object;

moving means for moving one of said drum and said seat member in a direction orthogonal to an axis of said drum; and follower means, comprising a rod-shaped support member having an axis extending orthogonal to an axis of said drum and parallel to a top surface of said seat member, for supporting said seat member and to produce a follower action in an interface contact region between the surface of the object and a contact surface of said polishing material providing equalized pressing pressure across said interface contact region.

21. An apparatus as claimed in claim 20, further comprising another moving means for moving one of said drum and said seat member in a direction parallel to said drum axis.

22. An apparatus as claimed in claim 21, wherein said another moving means is operable to reciprocate said one of said drum and said seat member in said parallel direction.

23. An apparatus as claimed in claim 20, further comprising rotation means for rotating said seat member and the object.

24. An apparatus as claimed in claim 20, further comprising control means for controlling pressing contact between said polishing material on said drum and the surface of the object so that a pressing pressure therebetween corresponds to a length of a substantially rectilinear interface region of contact therebetween.

25. An apparatus as claimed in claim 20, further comprising control means for controlling said revolving means such that a speed of revolving of said drum provides a constant rate of polishing while a length of a substantially rectilinear region of interface contact between said polishing material and the surface of the object varies.

26. An apparatus as claimed in claim 20, further comprising control means for controlling said moving means such that a relative speed of movement between said polishing material and the surface of the object varies inversely of variation in length of a substantially rectilinear region of interface contact therebetween.

27. A polishing apparatus for polishing a surface of an object to a uniform polish, said apparatus comprising:

a seat member to support an object to be polished;

a revolving drum confronting said seat member and a surface of the object, said drum having mounted on an outer circumferential surface thereof a polishing material;

revolving means for revolving said drum;

a pressing device to cause said polishing material on said drum and the surface of the object to be in pressing contact;

supply means for supplying a polishing solution to said polishing material, thereby to achieve polishing of the surface of the object;

moving means for moving one of said drum and said seat member in a direction orthogonal to an axis of said drum; and said pressing device comprising a diaphragm member connected to one of said seat member and said drum, and pneumatic cushion means for providing uniform pressure to said diaphragm member to produce a follower action in an interface contact region between the surface of the object and a contact surface of said polishing material providing equalized pressing pressure across said interface contact region.

28. An apparatus as claimed in claim 27, wherein said moving means is operable to reciprocate said one of said drum and said seat member in said orthogonal direction.

29. An apparatus as claimed in claim 27, further comprising another moving means for moving one of said drum and said seat member in a direction parallel to said drum axis.

30. An apparatus as claimed in claim 29, wherein said another moving means is operable to reciprocate said one of said drum and said seat member in said parallel direction.

31. An apparatus as claimed in claim 27, further comprising rotation means for rotating said seat member and the object.

32. An apparatus as claimed in claim 31, wherein said rotation means is operable to oscillatingly rotate said seat member and the object.

33. An apparatus as claimed in claim 27, further comprising control means for controlling pressing contact between said polishing material on said drum and the surface of the object so that a pressing pressure therebetween corresponds to a length of a substantially rectilinear interface region of contact therebetween.

34. An apparatus as claimed in claim 27, further comprising control means for controlling said revolving means such that a speed of revolving of said drum provides a constant rate of polishing while a length of a substantially rectilinear region of interface contact between said polishing material and the surface of the object varies.

35. An apparatus as claimed in claim 27, further comprising control means for controlling said moving means such that a relative speed of movement between said polishing material and the surface of the object varies inversely of variation in length of a substantially rectilinear region of interface contact therebetween.

36. A method for polishing a surface of an object to a uniform polish, said method comprising:

positioning said object in a seat member;

providing a drum having on an outer circumferential surface thereof a polishing material;

revolving said drum while maintaining pressing contact between said polishing material and said surface of said object;

supplying a polishing solution to said polishing material, thereby achieving polishing of said surface of said object;

moving one of said drum and said seat member in a direction orthogonal to an axis of said drum;

moving one of said drum and said seat member in a direction parallel to said drum axis; and rotating said seat member and said object about an axis of rotation of said seat member.

37. A method as claimed in claim 36, further comprising controlling said pressing contact between said polishing material and said surface of said object so that a pressing pressure therebetween corresponds to a length of a substantially rectilinear interface region of contact therebetween.

38. A method as claimed in claim 36, further comprising controlling speed of revolving of said drum to provide a constant rate of polishing while a length of a substantially rectilinear region of interface contact between said polishing material and said surface of said object varies.

39. A method as claimed in claim 36, further comprising controlling said moving so that relative speed of movement between said polishing material and said surface of said object varies inversely of variation in length of a substantially rectilinear region of interface contact therebetween.

* * * * *

UNITED STATES PATENT AND TRADEMARK OFFICE

CERTIFICATE OF CORRECTION

PATENT NO. : 5,643,056

DATED : July 1, 1997

INVENTOR(S) : Masayoshi HIROSE et al.

It is certified that error appears in the above-indentified patent and that said Letters Patent is hereby corrected as shown below:

Column 11, line 42, the first line of claim 5, change "claim 4" to --claim 20--.

Column 12, line 37, the first line of claim 16, change "claim 15" to --claim 23--.

Signed and Sealed this

Twenty-second Day of August, 2000

*Attest:*

Q. TODD DICKINSON

*Attesting Officer*

*Director of Patents and Trademarks*